US009561674B2

(12) United States Patent
Fukasawa et al.

(10) Patent No.: US 9,561,674 B2
(45) Date of Patent: Feb. 7, 2017

(54) INK-JET PRINTER

(71) Applicant: MIMAKI ENGINEERING CO., LTD., Nagano (JP)

(72) Inventors: Tsutomu Fukasawa, Nagano (JP); Masashi Hirano, Nagano (JP); Tsutomu Okano, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/026,605

(22) PCT Filed: Sep. 26, 2014

(86) PCT No.: PCT/JP2014/075554
§ 371 (c)(1),
(2) Date: Apr. 1, 2016

(87) PCT Pub. No.: WO2015/050042
PCT Pub. Date: Apr. 9, 2015

(65) Prior Publication Data

US 2016/0243861 A1 Aug. 25, 2016

(30) Foreign Application Priority Data

Oct. 4, 2013 (JP) ..... 2013-209357

(51) Int. Cl.
*B41J 25/00* (2006.01)
*B41J 2/01* (2006.01)
(Continued)

(52) U.S. Cl.
CPC ..... *B41J 25/001* (2013.01); *B41J 2/01* (2013.01); *B41J 19/005* (2013.01); *B41J 19/20* (2013.01); *B41J 19/202* (2013.01)

(58) Field of Classification Search
CPC ..... B41J 25/001; B41J 2/01; B41J 19/202; B41J 19/005; B41J 19/20
See application file for complete search history.

(56) References Cited

U.S. PATENT DOCUMENTS 4,693,618 A 9/1987 Hanagata

FOREIGN PATENT DOCUMENTS

JP S5873906 5/1983
JP H10250174 9/1998
(Continued)

OTHER PUBLICATIONS

"International Search Report (Form PCT/ISA/210)", mailed on Dec. 22, 2014, with English translation thereof, pp. 1-4, in which the listed references were cited.
(Continued)

*Primary Examiner* — Geoffrey Mruk
(74) *Attorney, Agent, or Firm* — Jianq Chyun IP Office

(57) ABSTRACT

An ink-jet printer is provided and includes: a motor, generating a driving force that prompts an ink-jet head moving in a main scanning direction relative to a print object; a motor, generating a driving force by which the ink-jet head is moved; a motor pulley, being rotated by the driving force generated by the motor; a first belt wound around the motor pulley to transmit the driving force from the motor pulley toward the ink-jet head; and a decelerating pulley on which the first belt is wound around to be rotated by the driving force transmitted on the first belt. At least one of a group of motor-side teeth of the motor pulley and belt-side teeth of the first belt and a group of deceleration-side teeth of the decelerating pulley and the belt-side teeth of the first belt is a combination of intermeshable spur gear teeth and helical gear teeth.

10 Claims, 10 Drawing Sheets

(51) Int. Cl.
*B41J 19/00* (2006.01)
*B41J 19/20* (2006.01)

(56) References Cited

FOREIGN PATENT DOCUMENTS

| | | | | |
|---|---|---|---|---|
| JP | 11-318779 | * 11/1999 | ..... | A47L 9/04 |
| JP | H11318779 | 11/1999 | | |
| JP | 2002-070991 | 3/2002 | | |
| JP | 2002227941 | 8/2002 | | |
| JP | 2006-275282 | 10/2006 | | |

OTHER PUBLICATIONS

"Search Report of European Counterpart Application", issued on Jun. 22, 2016, p. 1-p. 9, in which the listed references were cited.
"Office Action of Japan Counterpart Application" with English translation thereof, issued on Oct. 4, 2016, p. 1-p. 5.

* cited by examiner

INK-JET PRINTER

CROSS-REFERENCE TO RELATED APPLICATION

This application is a 371 application of the international PCT application serial no. PCT/JP2014/075554, filed on Sep. 26, 2014, which claims the priority benefit of Japan application no. 2013-209357, filed on Oct. 4, 2013. The entirety of each of the above-mentioned patent applications is hereby incorporated by reference herein and made a part of this specification.

TECHNICAL FIELD

This disclosure relates to an ink-jet printer.

BACKGROUND ART

Among the known devices wherein motive power is generated by drive sources and transmitted to operating units to realize desired operations, some of such devices transmit motive power using belts. For example, the Patent Literature 1 describes a floor nozzle for vacuum cleaner. This floor nozzle has a rotary brush rotatably attached to the interior of the floor nozzle, and a motor installed as a drive source to drive the rotary brush, wherein pulleys are attached to rotating shafts of the rotary brush and the motor, respectively. Further, a timing belt is wound around the pulleys in a tensioned condition to transmit the rotative force of the motor to the rotary brush to be rotated.

This floor nozzle for vacuum cleaner has an additional feature to reduce noises generated when the brush is rotating and to prevent the timing belt from disengaging from the pulleys. That is to say, spur gear teeth or helical gear teeth are included in teeth of the two pulleys and teeth of the timing belt to have the spur or helical gear teeth be intermeshed in any of sections of the two pulleys and the timing belt to be intermeshed.

CITATION LIST

Patent Literatures

Patent Literature 1: JP H11-318779 A

SUMMARY

Technical Problems

While the ink-jet printers are configured to discharge inks through ink-jet heads to print images or the like, some of such printers may employ the same technical means to move ink-jet heads in a main scanning direction. Specifically, motive power generated by a motor is transmitted on a timing belt toward an ink-jet head to move the ink-jet head. Conventionally, there is a possible problem with such an ink-jet printer configured to transmit the motive power on the timing belt toward the ink-jet head to move the ink-jet head. The problem is that contrasting shades of an ink possibly created in the main scanning direction on a print result may appear in the foist of streaks running in a sub scanning direction.

To address the conventional problem, this disclosure provides an ink-jet printer well-equipped for high-quality printing in which streaks may be reduced to appear in the sub scanning direction on a print result.

Solutions to the Problems

The inventors were led to the following facts through their tests and researches. The motive power generated by the drive source to be transmitted on the timing belt is transmitted between the pulleys and the timing belt whenever their teeth are intermeshed. The speed of rotation of the timing belt that transmits the motive power is inconstant and changes at timings when the teeth of the pulleys and the teeth of the timing belt are intermeshed. Taking pulleys relatively small in diameter for instance, a part of the timing belt wound around the pulleys is proportionately shorter with less intermeshable teeth. In case the pulleys rotate with the timing belt being wound around them, allowing their teeth to be intermeshed, the motive power transmitted then may have a greater impact than pulleys larger in diameter with more intermeshable teeth. This teaches that any speed changes at timings are prone to a greater increase with a smaller pulley diameter when the teeth of the pulleys and the teeth of the timing belt are intermeshed.

The inventors were further led to the following fact. The ink-jet head moved in the main scanning direction by the motive power transmitted on the timing belt change its moving speed in response to the speed changes of the timing belt. Furthermore, an ink discharged from the ink-jet head may land on a printed matter at different timings depending on the changing moving speeds of the ink-jet head. The ink landing on the printed matter at different timings may vary in quantity in the main scanning direction, creating contrasting shades of the ink in the main scanning direction on a print result. Such contrasting shades in the main scanning direction may appear in the form of streaks running in the sub scanning direction. The inventors, through their tireless efforts, finally found out the causation that streaks appeared in the sub scanning direction on a print result and then identified effective solutions to the problems.

This disclosure provides, in order to solve the problems, an ink-jet printer, including: an ink-jet head that discharges an ink on a print object while moving in a main scanning direction relative to the print object; a drive source that generates a driving force by which the ink-jet head is moved; an upstream pulley to be rotated by the driving force generated by the drive source; a toothed belt wound around the upstream pulley to transmit the driving force from the upstream pulley toward the ink-jet head; and a downstream pulley on which the toothed belt is wound around to be rotated by the driving force transmitted on the toothed belt, wherein the upstream pulley and the downstream pulley have teeth adapted to mesh with teeth of the tooted belt, and at least one of a group of the teeth of the upstream pulley and the teeth of the toothed belt to be intermeshed and a group of the teeth of the downstream pulley and the teeth of the toothed belt to be intermeshed is a combination of intermeshable spur gear teeth and helical gear teeth.

In the ink-jet printer disclosed herein, at least one of a group of the teeth to be intermeshed of the upstream pulley and of the toothed belt and a group of the teeth to be intermeshed of the downstream pulley and of the toothed belt is a combination of intermeshable spur gear teeth and helical gear teeth. Therefore, variability of the driving force may be reduced when it is transmitted from the drive source to the toothed belt. This may reduce speed changes of the ink-jet head during the printing operation, reducing the likelihood of contrasting shades of the ink in the main scanning direction on a print object. As a result, streaks on a print result in the sub scanning direction may be reduced and a high-quality printing may be achieved.

In the ink-jet printer, the upstream pulley and the downstream pulley have different diameters; it is preferably that a group of the teeth to be intermeshed of the toothed belt and of one of the upstream pulley and the downstream pulley smaller in diameter than the other be a combination of intermeshable spur gear teeth and helical gear teeth.

In the ink-jet printer disclosed herein, a group of the teeth to be intermeshed of the toothed belt and of one of the upstream pulley and the downstream pulley smaller in diameter than the other is a combination of intermeshable spur gear teeth and helical gear teeth. This may allow the driving force to be less variable in a part easily subject to changes in the transmitted driving force. This may reliably reduce speed changes of the ink-jet head during the printing operation, further reducing the possibility of streaks appearing on a print result in the sub scanning direction.

In addition, in the ink-jet printer, the upstream pulley is preferably smaller in diameter than that of the downstream pulley.

In the ink-jet printer disclosed herein, the upstream pulley is smaller in diameter than that of the downstream pulley, and a group of the teeth to be intermeshed of the toothed belt and of the upstream pulley is a combination of intermeshable spur gear teeth and helical gear teeth. Therefore, variability of the driving force may be reduced at positions on the upstream side of a driving force transmission path. The driving force generated by the drive source may be thereby reduced in variation and then transmitted toward the ink-jet head. This may more reliably reduce the speed changes of the ink-jet head. As a result, streaks appearing on a print result in the sub scanning direction may be more effectively reduced.

In the ink-jet printer, preferably, at least one of a group of the teeth of the toothed belt and the teeth of the upstream pulley to be intermeshed and a group of the teeth of the toothed belt and the teeth of the downstream pulley to be intermeshed is a combination of intermeshable spur gear teeth and helical gear teeth, and the other group is a combination of intermeshable spur gear teeth.

In the ink-jet printer disclosed herein, a group of the teeth to be intermeshed of the toothed belt and of the upstream pulley and a group of the teeth to be intermeshed of the toothed belt and of the downstream pulley may include a combination of intermeshable spur gear teeth. Therefore, an accurate rotation angle may be ensured when the driving force is transmitted toward the ink-jet head. This may effectively reduce the speed changes of the ink-jet head, while maintaining accuracy in the movement of the ink-jet head in the main scanning direction during the printing operation. As a result, streaks may be reduced to appear in the sub scanning direction on a print result with a high printing accuracy being secured, further high-quality printing may be ensured.

In the ink-jet printer disclosed herein, preferably, the downstream pulley transmits the driving force transmitted on the toothed belt toward the ink-jet head.

In the ink-jet printer, since the driving force transmitted on the toothed belt is transmitted by the downstream pulley toward the ink-jet head, the driving force reduced in variation may be transmitted toward the ink-jet head. This may more reliably reduce speed changes of the ink-jet head during the printing operation, further reducing the possibility of streaks appearing in the sub scanning direction on a print result.

Advantageous Effects of Invention

Thus, the ink-jet printer disclosed herein is advantageously well-equipped for high-quality printing, wherein streaks may be reduced to appear in the sub scanning direction on a print result.

DESCRIPTION OF EMBODIMENTS

An ink-jet printer according to an embodiment is hereinafter described in detail referring to the accompanying drawings. It should be understood that the embodiment hereinafter described does not restrict the scope of this disclosure. Structural elements described in the embodiment may include replaceable and readily available or substantially identical components.

[Embodiment]

Figure 1:
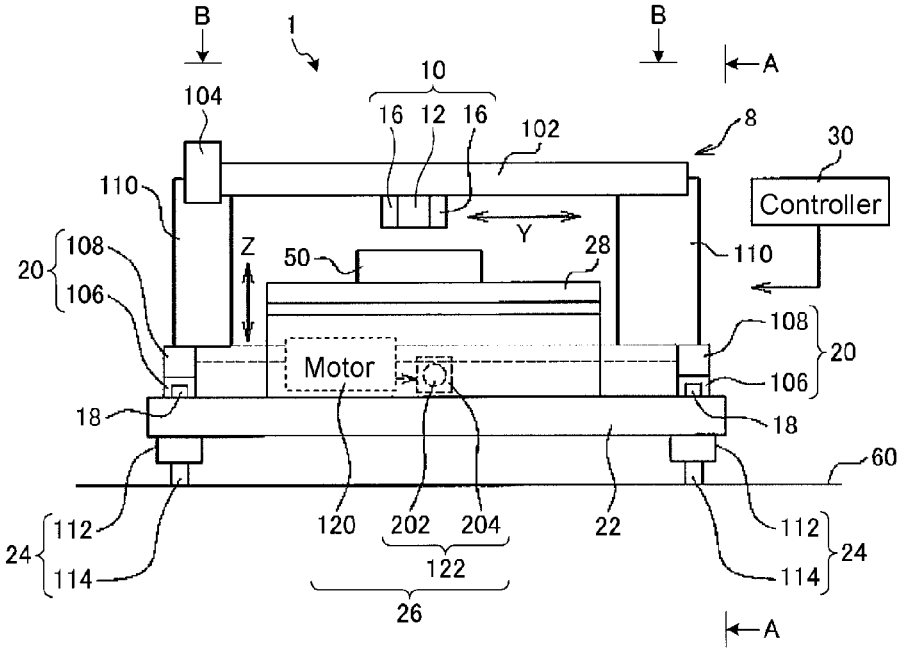
FIG. 1 is a schematic drawing of a structure of an ink-jet printer according to an embodiment.
Figure 2:
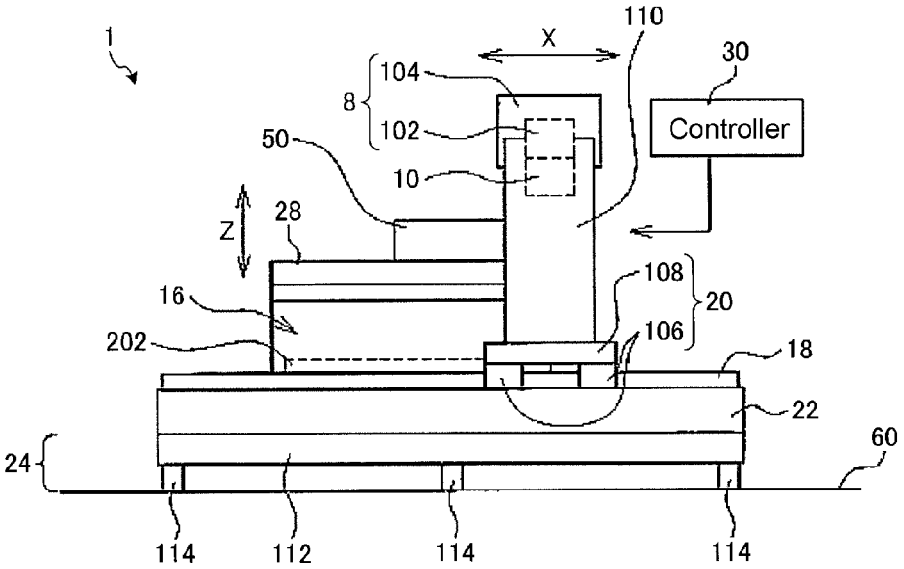
FIG. 2 is an A-A view of FIG. 1.

FIG. 1 is a schematic drawing of an ink-jet printer according to an embodiment. FIG. 2 is an A-A view of FIG. 1. An ink-jet printer 1 illustrated in these drawings performs ink-jet printing on a print object 50, for example, a three-dimensional object. This printer is equipped to print an image or the like on the print object 50 greater than or equal to 10 cm in height. The largest height of the print object 50 may be greater than or equal to 15 cm. The height of the print object 50 refers to a height in a direction in which ink droplets are discharged by an ink-jet head. According to this embodiment, this direction is Z direction illustrated in the drawings, which is parallel to a gravitational direction.

A region printable by the ink-jet printer 1 in Y direction may have a width greater than or equal to 30 cm, preferably, greater than or equal to 50 cm (for example, 50 to 80 cm), or more preferably, greater than or equal to 60 cm. The printable region in X direction may have a width greater than or equal to 30 cm (for example, 25 to 50 cm), or more preferably, greater than or equal to 40 cm.

According to this embodiment, the Y direction refers to a direction in which an ink-jet head moves along a guide rail during main scanning operation. This is a main scanning direction during a printing operation. The width of the printable region in the Y direction may refer to the width of a print target region to be printed by an ink-jet head during a main scanning operation. The X direction is a direction orthogonal to the Y direction and a Z direction. This is a sub scanning direction during the printing operation. The width of the printable region in the X direction may refer to the width of a movable range of an ink-jet head during a feed operation in which the ink-jet head is moved toward and away from the print object in the X direction.

The height of the whole ink-jet printer 1 according to this embodiment may be greater than or equal to 85 cm, more preferably, greater than or equal to 90 cm. The width of the whole ink-jet printer 1 in the Y direction may be greater than or equal to 120 cm, more preferably, greater than or equal to 140 cm. The width of the whole ink-jet printer 1 in the X direction may be greater than or equal to 80 cm, more preferably, greater than or equal to 90 cm.

The ink-jet printer 1 according to this embodiment is a flatbed ink-jet printer, including a Y bar section 8, a carriage 10, a medium stage 28, a platform section 22, two rails 18, two supporting members 20, leg sections 24, an X direction driving section 26, and a controller 30. The carriage 10 contains an ink-jet head 12 and ultraviolet ray irradiating sections 16. The flatbed ink-jet printer refers to an ink-jet printer configured to move the Y bar section 8 in the X direction to carry out the feed operation in which the ink-jet head 12 is moved toward and away from the print object 50 in the X direction.

For expediency of illustration, this embodiment provides the ink-jet head 12 and the ultraviolet ray irradiating sections 16 as components independent of the Y bar section 8. In actually designing the ink-jet printer 1 for commercial use, the Y bar section 8 may be a unit including the ink-jet head 12 and the ultraviolet ray irradiating sections 16.

The ink-jet head 12 contained in the carriage 10 is a printing head from which ink droplets are discharged on the print object 50. This ink-jet head 12, for example, may discharge ink droplets in CMYK (cyan, magenta, yellow, and key plate) colors for color printing, or the ink-jet head 12, for example, may discharge ink droplets of a clear ink instead of the CMYK color inks. Furthermore, according to this embodiment, the ink-jet head 12 discharges ink droplets of an ink of ultraviolet curing type.

The Y bar section 8 has a component that prompts the ink-jet head 12 to perform main scanning operation. According to this embodiment, the Y bar section 8 has a guide rail 102, a Y direction driving section 104, and side surface sections 110. The guide rail 102 is a member in the form of a rail for holding the ink-jet head 12 so as to face the print object 50. According to this embodiment, the guide rail 102 is an exemplified member of extending in the Y direction.

The Y direction driving section 104 is a driver that drives the carriage 10 to move along the guide rail 102. According to this embodiment, the Y direction driving section 104 is disposed on one end side of the guide rail 102 in the Y direction to move the carriage 10 in the Y direction as corresponding to commands by the controller 30 during main scanning operation. During the printing by main scanning operation, the ink-jet head 12 contained in the carriage 10, while moving along the guide rail 102, discharges ink droplets on the print object 50. The side surface sections 110 refer to parts of the Y bar section 8 on its lateral sides. The side surface section 110 support one end and the other end of the guide rail 102 and the Y direction driving section 104 to locate the ink-jet head 12 so as to face the print object 50.

The ultraviolet ray irradiating sections 16 mounted in the carriage 10 with the ink-jet head 12 are light sources that emit ultraviolet ray (UV ray) to cure the ink of ultraviolet curing type. According to this embodiment, the ultraviolet ray irradiating sections 16, by being contained in the carriage 10 with the ink-jet head 12, are supported by the guide rail 102. The ultraviolet ray irradiating sections are disposed on both sides of the ink-jet head 12 in the Y direction. The ultraviolet ray irradiating sections 16 thus arranged to cure the ink discharged from the ink-jet head 12 that landed on the print object 50 during main scanning operation.

The medium stage 28 is a table on which the print object 50 is held. The medium stage 28 holds the print object 50 on its upper surface to locate the print object 50 so as to face the ink-jet head 12. In addition, according to this embodiment, the medium stage 28 is an example of print object mounting tables for print objects to be mounted thereon. The medium stage 28 has a mechanism that moves the position of its upper surface upward and downward in the Z direction. The medium stage 28, by changing the upper surface position in accordance with the shape of the print object 50, adjusts a distance between the ink-jet head 12 and the print object 50. Optionally, the upper surface of the medium stage 28 may be equipped with a jig (attachment) that holds the print object 50 in a manner that is tailored to the shape of the print object 50. This additional means may allow three-dimensional objects in a variety of shapes to be held on the medium stage as the print object 50.

The platform section 22 is a member in the form of a table provided at a lower position in the gravitational direction than, for example, the ink-jet head 12 and the guide rail 102, to place the other components on its upper surface. The platform section 22 has preferably greater in width than the guide rail 102 in the Y direction. The platform section 22 preferably at least has a width in the X direction greater than a movable range of the guide rail 102 in the X direction.

The two rails 18 are exemplified guide members. These rails are extending in the X direction on the platform section 22 to guide the movements of the supporting members 20. The two guide rails 18 also guide the movement in the X direction of the Y bar section 8 supported by the supporting members 20.

According to this embodiment, the two rails 18 are respectively disposed on one end side and the other end side of the platform section 22 in the Y direction. The two rails 18 thus arranged to guide the movement of the Y bar section 8 on both sides of the Y bar section 8 in the Y direction. In connection with the positions of the two rails 18, one end side and the other end side of the platform section 22 in the Y direction may specifically refer to its end parts or in proximity to the end parts. Specifically, "in proximity to the end parts" may refer to positions distant from the end parts by a certain margin.

The supporting members 20 are disposed on the platform section 22 to support the Y bar section 8. According to this embodiment, each of the supporting members 20 has a guided section 106 and a Y bar mounting section 108. The guided sections 106 are parts of configurations of being movable in the X direction along the rails 18. Each of the guided sections 106 of the two supporting members 20 is guided by the respective two rails 18. The Y bar mounting section 108 is located between the guided section 106 and the Y bar section 8. The Y bar mounting sections 108, with the side surface sections 110 of the Y bar section 8 being mounted thereon, support the Y bar section 8 on the rails 18.

According to this embodiment, the guide rail 102 of the Y bar section 8 is disposed at an upper position in the gravitational direction, and the guided sections 106 of the supporting members 20 are disposed at lower positions in the gravitational direction. These upper and lower members, with a part of the medium stage 28 mounted with the print object 50 located in the middle, are distantly spaced from each other in the gravitational direction.

The X direction driving section 26 is a driver that drives the Y bar section 8 to move along the rails 18 in the X direction. According to this embodiment, the X direction driving section 26 has a motor 120 and a ball screw 122. The motor 120 is an example of drive sources to rotate the ball screw 122. The motor 120 may be a servo motor.

The ball screw 122 includes a ball screw shaft 202 and a ball screw nut 204. Rotating the ball screw 122 is, in this case, to rotate the ball screw shaft 202. According to this embodiment, both ends of the ball screw shaft 202 of the ball screw 122 are fixed on the platform section 22 via bearings. The ball screw shaft 202 thus arranged is rotatably supported at a predetermined position on the platform section 22. In addition, the ball screw shaft 202 is supported, with its direction of axis in parallel to the X direction, on the platform section 22. On the other hand, according to this embodiment, the ball screw nut 204 of the ball screw 122 is fixed relative to the Y bar section 8. The ball screw nut 204 of the ball screw 122 is fixable relative to the Y bar section 8, for example, by fixing the ball screw nut 204 into the Y bar mounting sections 108. In this instance, the Y bar mounting section 108 is preferably a plate-shaped member transversely extending in the Y direction above the platform section 22.

In the case of above configurations, as the ball screw shaft 202 of the ball screw 122 is rotated, the ball screw nut 204 moves forward or backward in the X direction depending on a direction in which the ball screw shaft 202 rotates. The ball screw nut 204 thereby functions as a converting mechanism that converts the rotation of the ball screw 122 into a linear motion. The Y bar section 8 also moves in the X direction in response to the movement of the ball screw nut 204. According to this embodiment, the Y bar section 8 may be adequately moved in the X direction with the aid of the ball screw 122.

According to this embodiment, the bearings supporting the both ends of the ball screw shaft 202 are fixed on the platform section 22, though not illustrated in the drawings for expediency of illustration. As for the bearings supporting the both ends of the ball screw shaft 202, ball bearings may preferably be used to support the ball screw shaft 202.

The X direction driving section 26 may further include components or the like for power transmission between the motor 120 and the ball screw 122. The X direction driving section 26 may move the Y bar section 8 in the X direction at intervals between main scanning operations. As such, the ink-jet printer 1 carries out the feed operation at intervals between main scanning operations. The ink-jet printer 1 performs main scanning operation subsequent to stoppage of the movement of the Y bar section 8 in the X direction.

The leg sections 24 have a component of being provided to support the platform section 22. The leg sections 24 are attached to the bottom-surface side of the platform section 22 to support the platform section 22 on a mounting surface 60. The bottom-surface side of the platform section 22 refers to a lower-surface side in the gravitational direction. The mounting surface 60 may be, for example, a floor or an upper surface of a table or the like on which the ink-jet printer 1 is mountable.

According to this embodiment, the leg sections 24 include two connecting sections 112 and four or more (desirably, six or more) projecting sections 114. The connecting sections 112 are long members extending in parallel to the rails 1. The connecting sections 112 are disposed on the bottom-surface side of the platform section 22. The two connecting sections 112 are respectively disposed on one end side and the other end side of the platform section 22 in the Y direction.

The projecting sections 114 serve as legs supporting the whole ink-jet printer 1. The projecting sections 114 are projecting downward in the gravitational direction from the connecting sections 112 to abut the mounting surface 60, thereby supporting the platform section 22 on the mounting surface 60. According to this embodiment, multiple (preferably, three or more) projecting sections 114 are attached to each of the connecting sections 112. For example, it may be contemplated to provide the projecting sections 114 at the center and both ends of each one of the connecting sections 112 in the X direction. In this instance, there are three projecting sections 114 for each of the two connecting sections 112; six projecting sections 114 in total. As such a configuration, the ink-jet printer 1 may be robustly supported on the mounting surface 60.

As for a positional relationship among the rails 18, connecting sections 112, and projecting sections 114, these members may preferably lie on a straight line at upper and lower positions in the gravitational direction. Specifically, the positional relationship may preferably be such that the connecting sections 112 and the rails 18 are opposed to each other with the platform section 22 interposed therebetween, and the projecting sections 114 and the rails 18 are opposed to each other with the connecting section 112 and the platform section 22 interposed therebetween.

The controller 30 may be the CPU (Central Processing Unit) of the ink-jet printer 1. The controller 30 may be mounted in the interior of the printer, such as the platform section 22 or side surface section 110 or the like, to control the operations of the structural elements of the ink-jet printer 1. During a main scanning operation, the controller 30 may control the ink-jet head 12 to perform the printing at positions on the print object 50 in the Y direction. During the feed operation carried out at intervals between main scanning operations, the controller 30 may control the X direction driving section 26 to move the Y bar section 8 in the X direction, thereby successively changing a print target region of the print object 50 for main scanning operations that follow. According to this embodiment, therefore, the printing operation may be properly performed at different positions on the print object 50.

Figure 3:
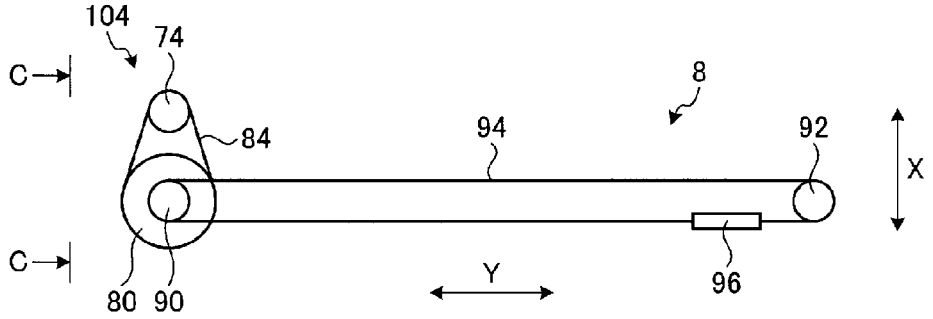
FIG. 3 is a B-B view of FIG. 1, illustrating a drive system in connection with a Y bar section and a Y direction driving section.
Figure 4:
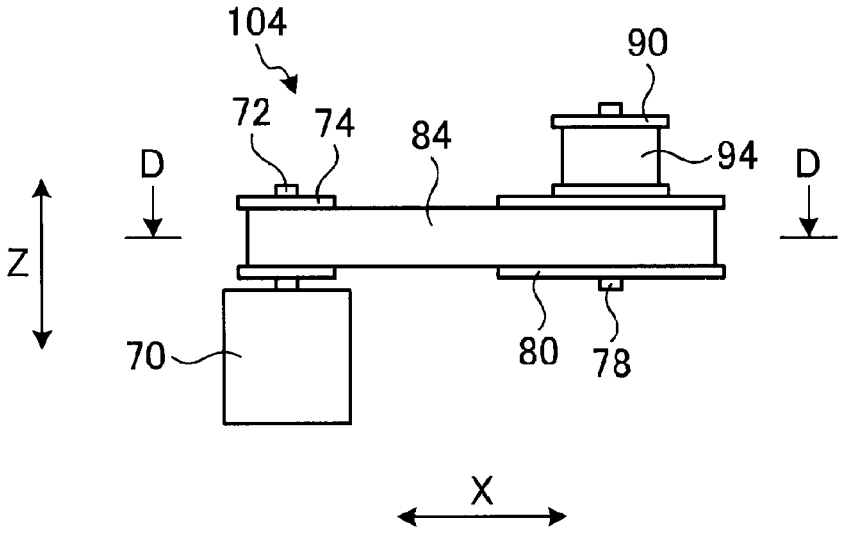
FIG. 4 is a C-C view of FIG. 3.

FIG. 3 is a B-B view of FIG. 1, illustrating a drive system in connection with the Y bar section and the Y direction driving section. FIG. 4 is a C-C view of FIG. 3. The Y direction driving section 104 has a motor 70 which is an electrically operated drive source that generates motive power. The motive power generated by the motor 70 is outputted, and the carriage 10 is moved in the Y direction by the motive power outputted from the motor 70. This power output and movement of the carriage 10 are exercised by toothed belts having teeth on their power transmission sides. The motor 70 has a motor shaft 72, which is the output shaft of the motor 70, extending in the Z direction. A motor pulley 74 is attached to the motor shaft 72. The motor pulley 74 may include a pulley for toothed belt and the like having teeth to be meshed with the teeth of a toothed belt.

The Y direction driving section 104 has a decelerating pulley 80 in vicinity of the motor pulley 74. As with the motor pulley 74, the decelerating pulley 80 may include a pulley for toothed belt having teeth to be meshed with the teeth of a toothed belt. The decelerating pulley 80 is attached to a rotating shaft 78 extending in the Z direction so as to rotate integrally with the rotating shaft 78. The position of the decelerating pulley 80 in a direction of Z axis is substantially coincident with the position of the motor pulley 74 in the direction of Z axis. The decelerating pulley 80 is larger in diameter than that of the motor pulley 74.

A first belt 84 including a toothed belt is wound around the motor pulley 74 to the decelerating pulley 80. Assuming that the location of the drive source, or motor 70, refers to the upstream side in the driving force transmission path, the motor pulley 74 is an upstream pulley rotated by the driving force generated by the motor 70, while the decelerating pulley 80 is a downstream pulley rotated by the driving force transmitted on the first belt 84.

In addition to the decelerating pulley 80, a driving pulley 90 is mounted to the rotating shaft 78. The driving pulley 90 includes a pulley for toothed belt. The driving pulley 90 is smaller in diameter than that of the decelerating pulley 80 and rotatable integrally with the rotating shaft 78. That is to say, the driving pulley 90 is rotatable integrally with the decelerating pulley 80.

A driven pulley 92 including a pulley for toothed belt like the driving pulley 90 is disposed at an end part of the Y bar section 8 in the Y direction opposite to the other end part at which the Y direction driving section 104 is disposed. The driven pulley 92 is freely rotatable with its direction of axis coinciding with the Z direction. The position of the driven pulley 92 in the Z direction substantially matches the position of the driving pulley 90 in the Z direction. A second belt 94 including a toothed belt is wound around the driving pulley 90 to the driven pulley 92. Specifically, the second belt 94 is wound around the driving pulley 90 to the driven pulley 92 along the guide rail 102 of the Y bar section 8.

The second belt 94 has a carriage-attachable section 96 to which the carriage 10 is attachable. The decelerating pulley 80 is rotated integrally with the driving pulley 90 by the driving force transmitted on the first belt 84. The decelerating pulley 80 is provided so as to transmit the driving force transmitted on the first belt 84 toward the ink-jet head 12.

Figure 5:
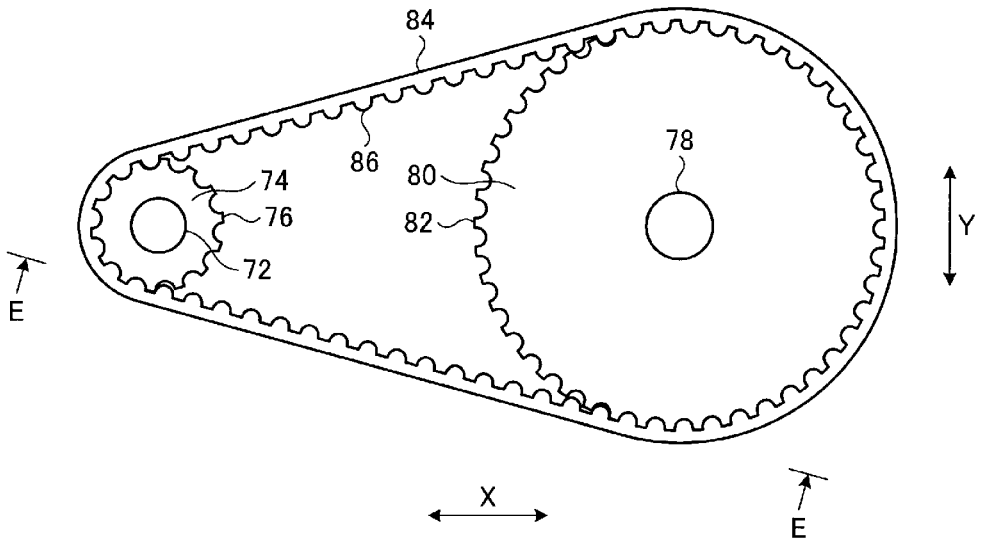
FIG. 5 is a D-D sectional view of FIG. 4.
Figure 6:
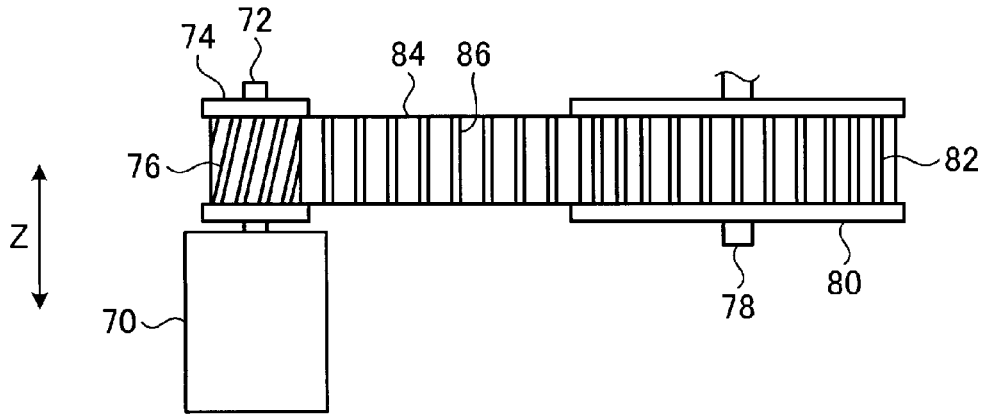
FIG. 6 is an E-E sectional view of FIG. 5.

FIG. 5 is a D-D sectional view of FIG. 4. FIG. 6 is an E-E sectional view of FIG. 5. The motor pulley 74 and the decelerating pulley 80, which are both pulleys for toothed belt, have teeth formed on their outer peripheral surfaces. The teeth of these pulleys are formed so as to mesh with belt-side teeth 86 of the first belt 84. Specifically, motor-side teeth 76 are formed on the outer peripheral surface of the motor pulley 74 to mesh with the belt-side teeth 86. Deceleration-side teeth 82 are formed on the outer peripheral surface of the decelerating pulley 80 to mesh with the belt-side teeth 86.

A large number of belt-side teeth 86 are formed on an inner peripheral surface of the first belt 84 and extending in a direction orthogonal to the circumferential direction of the first belt 84. These teeth are formed collaterally in the circumferential direction of the first belt 84. The multiple belt-side teeth 86 are formed on the inner peripheral surface of the first belt 84 along the width direction of the first belt 84 and projecting from the inner peripheral surface of the first belt 84.

On the contrary, the motor-side teeth 76 and the deceleration-side teeth 82 are formed in different directions. The motor-side teeth 76 are inclined relative to the direction of axis of the motor pulley 74. The deceleration-side teeth 82 are formed along the direction of axis of the decelerating pulley 80. The motor pulley 74 thus having the motor-side teeth 76 inclined relative to the direction of axis of the motor pulley 74 is a generally called helical gear pulley. The decelerating pulley 80 having the deceleration-side teeth 82 formed along the direction of axis of the decelerating pulley 80 is a generally called spur gear pulley.

Specifically, a large number of deceleration-side teeth 82 are formed on an outer peripheral surface of the decelerating pulley 80 and projecting from the outer peripheral surface of the decelerating pulley 80. These teeth are formed along a direction in which the rotating shaft 78 is extending and collaterally in the circumferential direction of the decelerating pulley 80.

A large number of motor-side teeth 76 are formed on an outer peripheral surface of the motor pulley 74 so as to project from the outer peripheral surface of the motor pulley 74. These teeth are inclined relative to a direction in which the motor shaft 72 is extending and formed collaterally in the circumferential direction of the motor pulley 74. The number of the motor-side teeth 76 formed in the motor pulley 74 smaller in diameter than that of the decelerating pulley 80 is fewer than the number of the deceleration-side teeth 82 formed in the decelerating pulley 80.

The motor-side teeth 76 may preferably be inclined relative to the direction in which the motor shaft 72 is extending through an angle greater than 0° and less than or equal to 2°.

Figure 7:
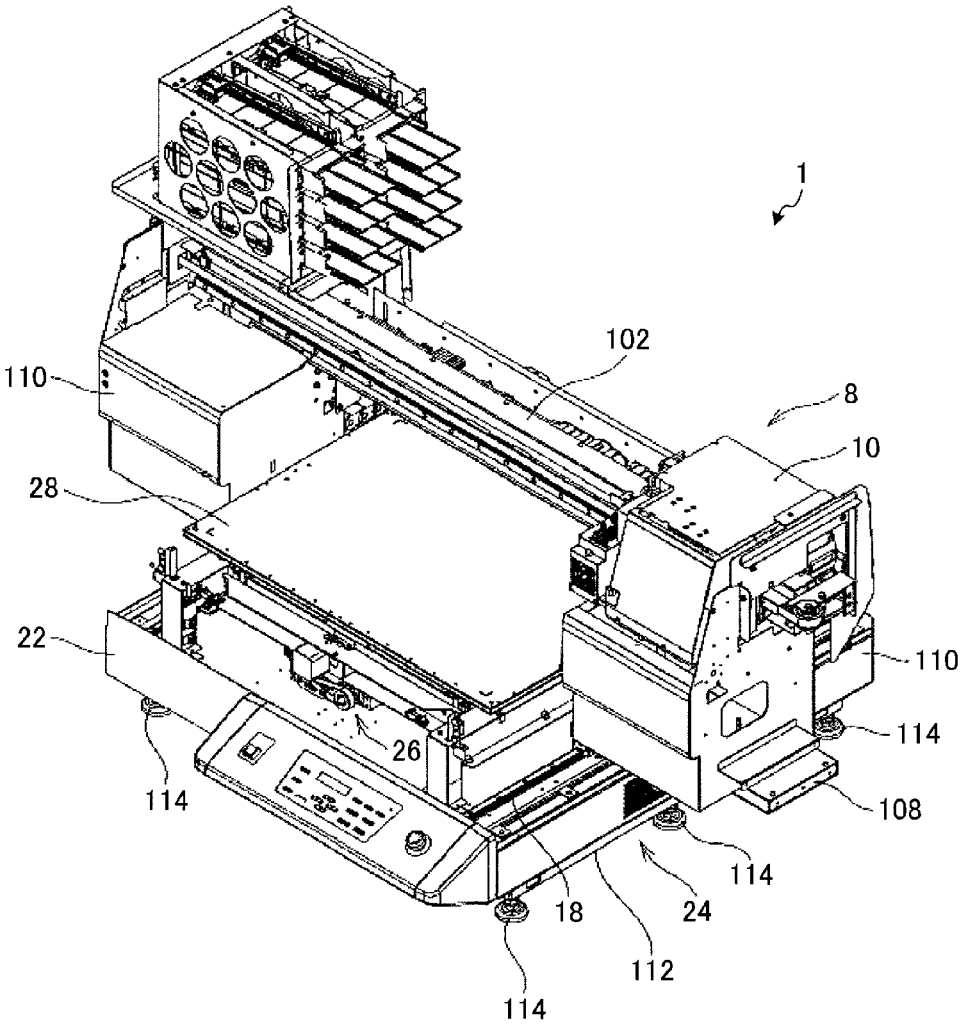
FIG. 7 is an upper perspective view of an ink-jet printer, illustrating exemplified structural features of the printer in further detail.
Figure 8:
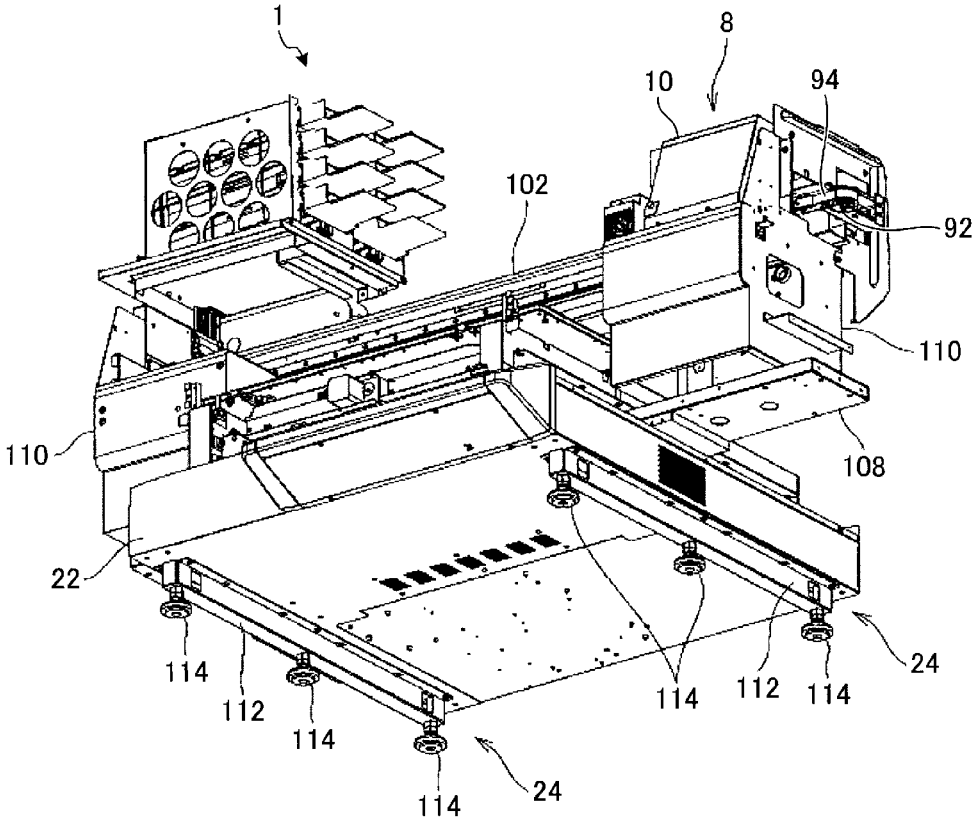
FIG. 8 is a perspective view of the ink-jet printer illustrated in FIG. 7 on its lower side.
Figure 9:
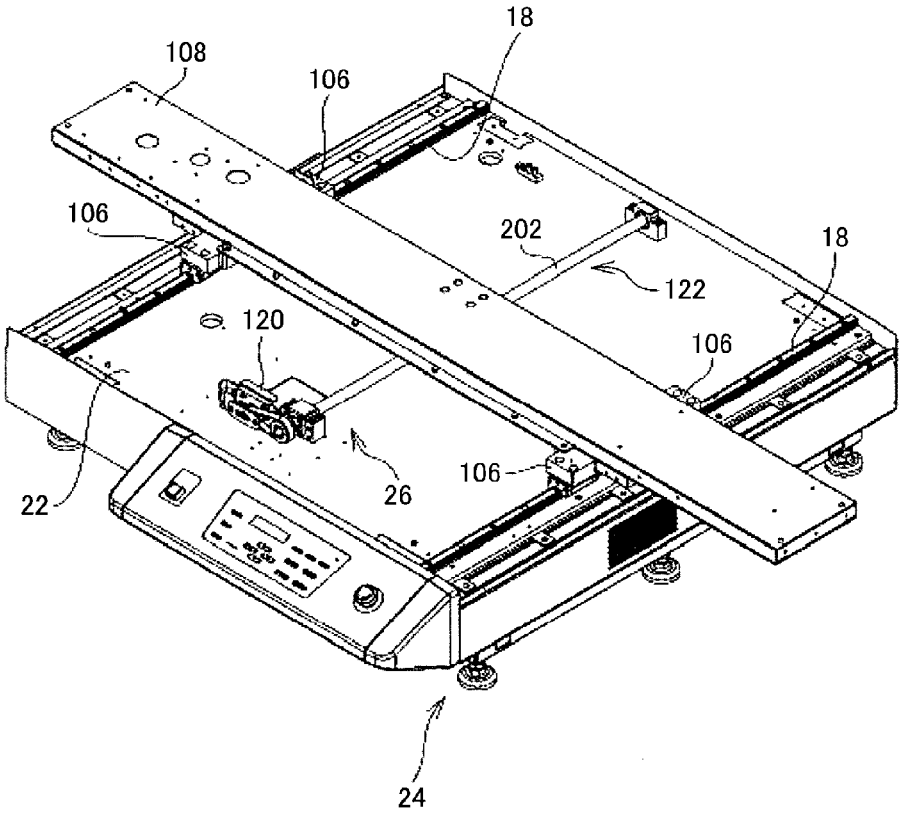
FIG. 9 is a perspective view of the ink-jet printer illustrated in FIG. 7 from which the Y bar section and a medium stage have been removed.
Figure 10:
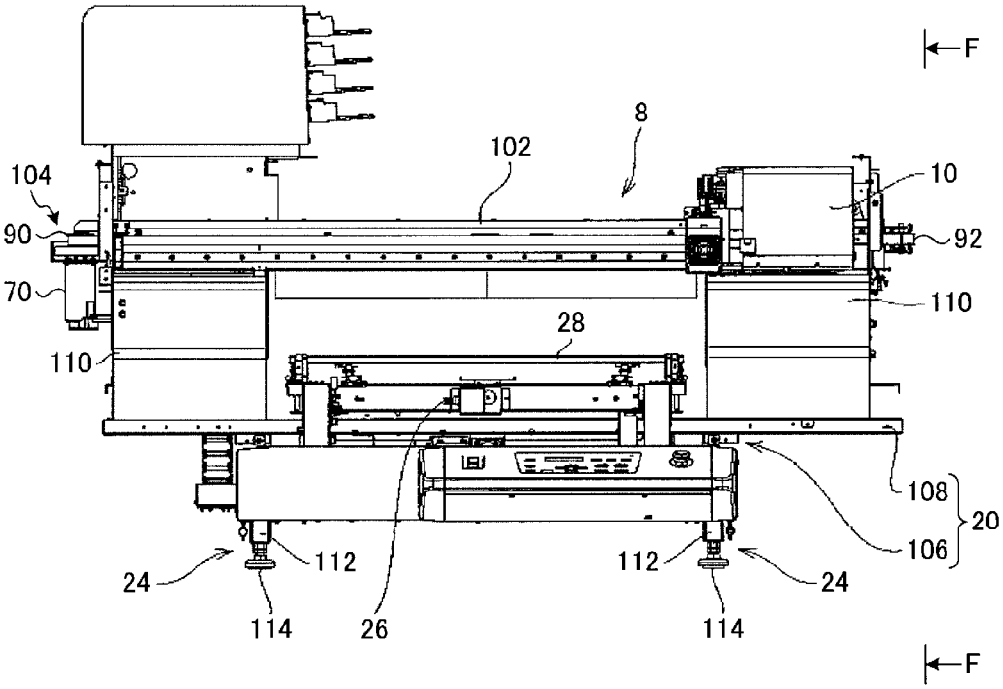
FIG. 10 is a front view of the ink-jet printer illustrated in FIG. 7.
Figure 11:
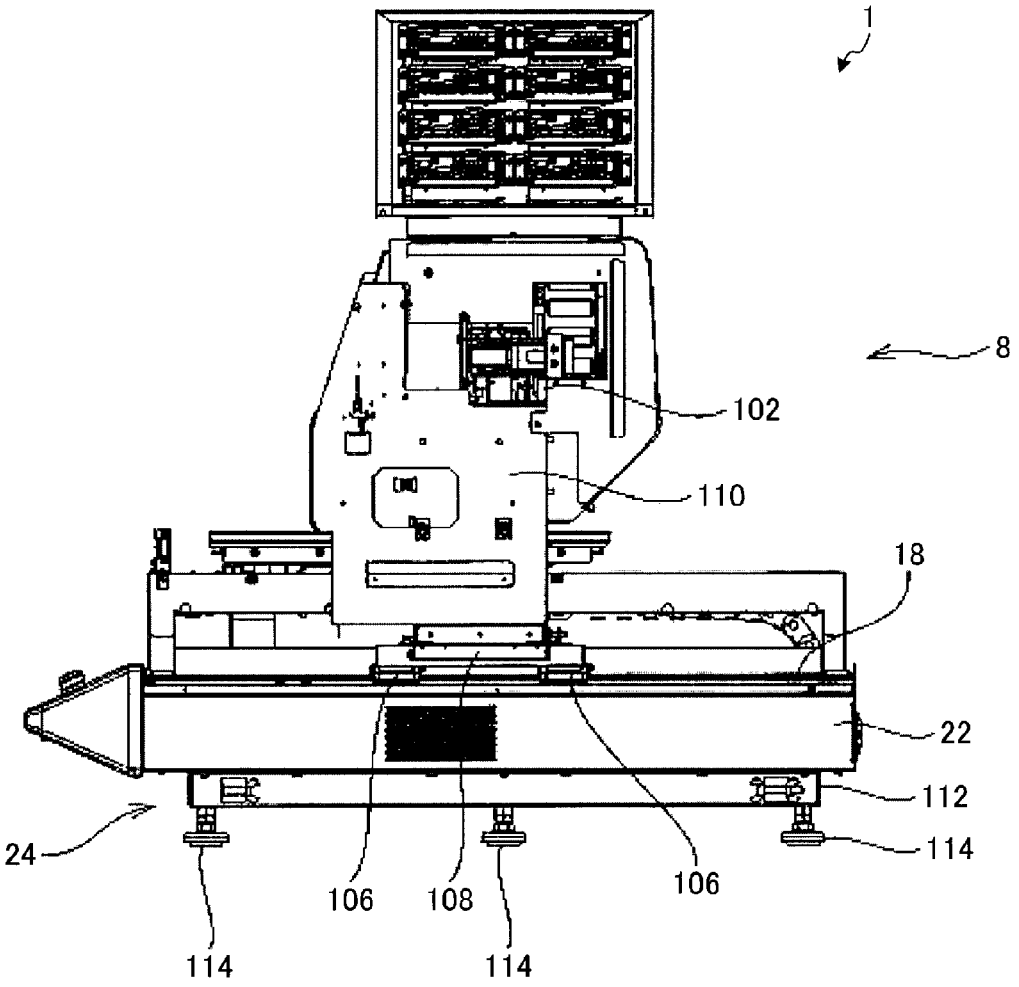
FIG. 11 is an F-F view of FIG. 10.

FIGS. 7 through 11 are drawings, illustrating in further detail exemplified structural features of the ink-jet printer according to this embodiment. FIG. 7 is an upper perspective view of the ink-jet printer. FIG. 8 is a perspective view of the ink-jet printer illustrated in FIG. 7 on its lower side. FIG. 9 is a perspective view of the ink-jet printer illustrated in FIG. 7 from which the Y bar section and the medium stage have been removed. FIG. 10 is a front view of the ink-jet printer illustrated in FIG. 7. FIG. 11 is an F-F view of FIG. 10. In connection with the structural features illustrated in FIGS. 7 through 11 (hereinafter, structural features of FIG. 7 or the like), its specific features in part are different to the illustrations of FIGS. 1 and 2. These differences, however, result from expediency in designing specific components of the printer. Except for those hereinafter described, structural elements illustrated in FIGS. 7 to 11 with the same reference signs as in FIGS. 1 and 2 are identical or similar to the ones illustrated in FIGS. 1 and 2.

Referring to FIG. 7, the ink-jet printer 1 has an overall height of approximately 95 cm. The width of the printer in the Y direction is approximately 150 cm, and its width in the X direction is approximately 100 cm. A printable region of the ink-jet printer 1 is 60 cm in width in the Y direction and 42 cm in width in the X direction.

The ball screw shaft 202 of the ball screw 122 in the X direction driving section 26 moves by approximately 10 cm in the X direction for each full rotation of the motor 120. A ratio of the rotation of the motor 120 to the movement of the ball screw shaft 202 (moderating ratio) may be approximately 3:1.

The medium stage 28 is structured such that a jig (attachment) is attachable to its upper surface. The attachable jig is specifically less than or equal to 10 cm in height and movable within the dimension of 5 cm in the Z direction on the upper surface of the medium stage 28. By attaching or detaching the jig to and from the medium stage 28 in accordance with the shape of the print object 50, any print objects 50 at most 15 cm in height (for example, ranging from 0.1 mm to 15 cm in height) may be printable.

Referring to FIG. 7, a member mountable on both of the two guided sections 106 is used as the Y bar mounting section 108, which is more clearly known from FIG. 9. This member is a plate-shaped member transversely extending in the Y direction above the platform section 22. Since the Y bar mounting section 108 is a member having such a shape, the medium stage 28 has an inner aperture to let the member, or Y bar mounting section 108, partly pass therethrough, as is known from FIGS. 10 and 11. The ball screw nut of the ball screw 122 is fixed to the Y bar mounting section 108.

Figure 12:
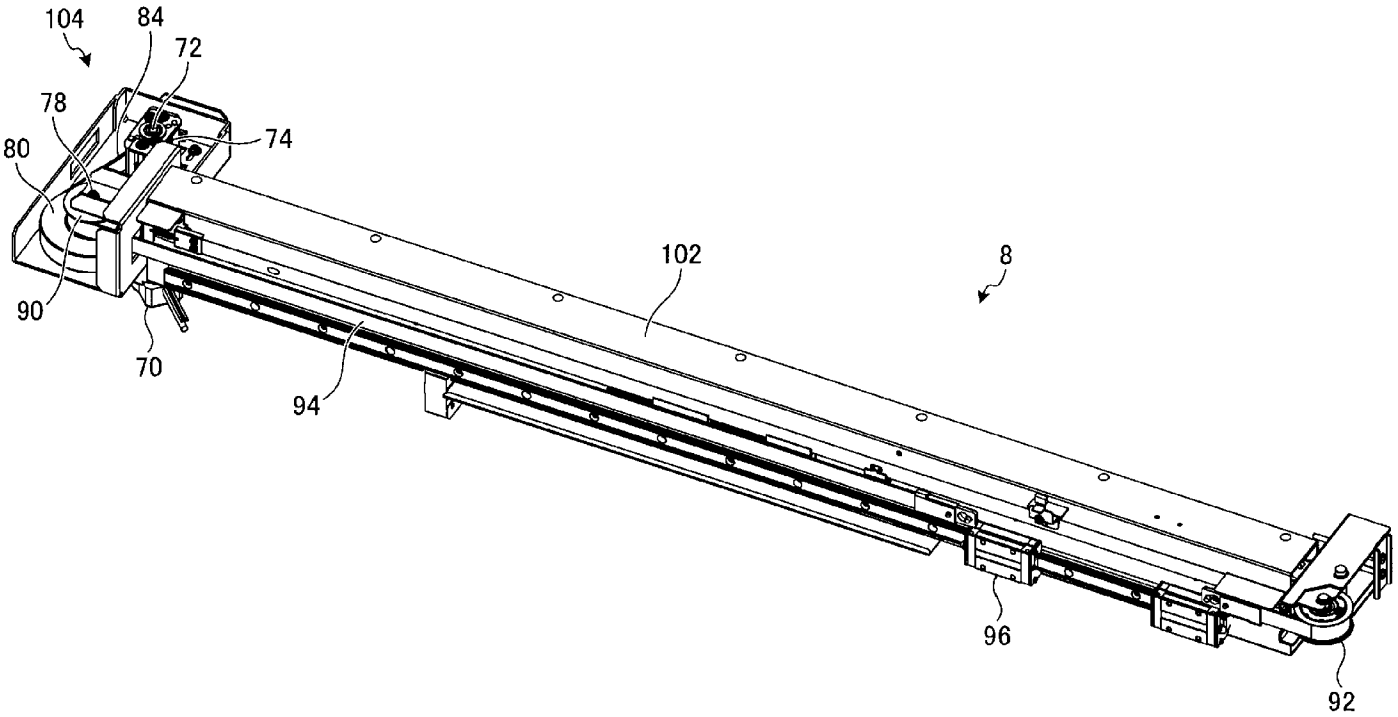
FIG. 12 is a graphical illustration of a drive system in connection with a Y bar section and a Y direction driving section illustrated in FIG. 7.

FIG. 12 is a drawing of a drive system in connection with the Y bar section and the Y direction driving section illustrated in FIG. 7. Referring to FIG. 7, the Y direction driving section 104 has the motor 70 as a drive source, wherein the motor pulley 74 is attached to the motor shaft 72. The driving pulley 90, on which second belt 94 with the carriage-attachable section 96 is wound around, is rotatable coaxially with the decelerating pulley 80 on which the first belt 84 is wound around as well as the motor pulley 74.

The motor pulley 74 thus having the motor-side teeth 76 (see FIG. 6) inclined relative to the direction of axis is a helical gear pulley. The decelerating pulley 80 having the deceleration-side teeth 82 (see FIG. 6) formed along the direction of axis is a spur gear pulley. The belt-side teeth 86 (see FIG. 6) of the first belt 84 are formed in a direction orthogonal to the circumferential direction of the first belt 84.

The ink-jet printer 1 according to this embodiment is structured as described above. Hereinafter, the operation of this printer is described. To print an image or the like on the print object 50 using the ink-jet printer 1, the print object 50 is held on the medium stage 28, and the medium stage 28 is controlled by the controller 30 suitably for the thickness in the Z direction of the print object 50 on the medium stage 28. By thus operating the medium stage 28, the position of the upper surface of the medium stage 28 in the Z direction is adjusted to adjust the position of a print surface of the print object 50. Specifically, the position of the upper surface of the medium stage 28 in the Z direction is adjusted so that the upper surface of the print object 50 in the Z direction is located at a position at which an image or the like is printable thereon with ink droplets discharged from the ink-jet head 12.

Then, the controller 30 controls the X direction driving section 26 to move the Y bar section 8 in the X direction. This movement changes relative positions in the X direction of the print object 50 and the carriage 10 containing the ink-jet head 12 and the ultraviolet ray irradiating sections 16, thereby locating the ink-jet head 12 and the ultraviolet ray irradiating sections 16 to meet the print position of the print object 50 in the X direction.

The controller 30 further controls the Y direction driving section 104 to move the carriage 10 in the Y direction. Then, ink droplets suitable for an intended printing are discharged from the ink-jet head 12 on the print object 50 and irradiated with ultraviolet ray emitted from the ultraviolet ray irradiating sections 16 to cure the ink on the print object 50.

The controller 30 carries out the printing operation by driving the Y direction driving section 104 to move the carriage 10 in the Y direction which is the main scanning direction. After an image or the like is printed at a predetermined position on the print object 50 in the X direction, the controller 30 drives the X direction driving section 26 to change relative positions of the print object 50 and the carriage 10 in the X direction which is the sub scanning direction. After the relative positions of the print object 50 and the carriage 10 are changed, the controller 30 drives the Y direction driving section 104 again for the printing operation to be carried out at a predetermined position on the print object 50 in the X direction. By repeating these steps to print an image or the like on the print object 50 using the ink-jet printer 1, the printing operation is carried out for a predetermined range in the X and Y directions on the print surface of the print object 50.

To print an image or the like on the print object 50, the Y direction driving section 104 is also driven, and the Y direction driving section 104 transmits the motive power generated by the motor 70 by way of the toothed belts to move the carriage 10. The transmission of motive power is described. When the motor shaft 72 is rotated by driving the motor 70, the motor pulley 74 attached to the motor shaft 72 is rotated.

As the motor pulley 74 rotates, the first belt 84 wound around the motor pulley 74 rotates with the motor pulley 74. As the first belt 84 rotates, the decelerating pulley 80, on which the first belt 84 is wound around, rotates with the first belt 84. The decelerating pulley 80 greater in diameter than that of the motor pulley 74 has a smaller number of revolutions per unit time. The decelerating pulley 80, therefore, rotates at a lower speed with an increased torque.

As the decelerating pulley 80 rotates, the driving pulley 90 that rotates coaxially with the decelerating pulley 80 rotates integrally with the decelerating pulley 80. As the driving pulley 90 rotates, the second belt 94 wound around the driving pulley 90 to the driven pulley 92 rotates with the driving pulley 90. A part of the second belt 94 extending along the guide rail 102 moves in the Y direction along the guide rail 102.

The carriage-attachable section 96 of the second belt 94 moves in the Y direction with the second belt 94 moving in the Y direction. The carriage 10 containing the ink-jet head 12 and the ultraviolet ray irradiating sections 16 is attached to the carriage-attachable section 96 that moves in the Y direction when the Y direction driving section 104 is driven. By driving the Y direction driving section 104, therefore, the carriage 10 moves in the Y direction along the guide rail 102.

Figure 13:
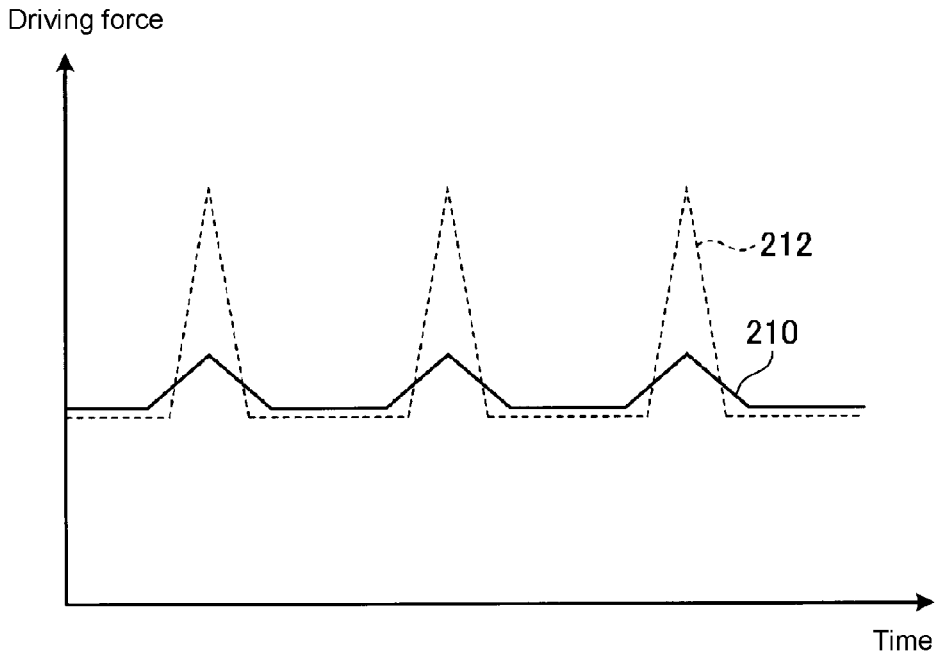
FIG. 13 is a graphical illustration of the transmission of driving forces from the Y direction driving section.

FIG. 13 is a graphical illustration of the transmission of driving forces from the Y direction driving section. The carriage 10 is moved in the Y direction by actuating the motor 70 of the Y direction driving section 104 and transmitting the motive power generated by the motor 70 toward the carriage 10 by way of the pulleys including the motor pulley 74 and the belts including the first belt 84. The transmission of the driving force toward the carriage 10 is described below. The first belt 84 and the second belt 94 are the toothed belts. The motor pulley 74, decelerating pulley 80, driving pulley 90, and driven pulley 92 are the pulleys for toothed belt. The driving force is transmitted to and from the pulleys and the belts by way of intermeshing engagement between the teeth on the outer peripheral surfaces of the pulleys and the teeth on the inner peripheral surfaces of the belts.

The teeth of the pulleys are spaced at given intervals in the circumferential direction of the pulleys. The teeth of the belts are spaced at given intervals in the circumferential direction of the belts. In the pulleys and the belts which are both rotatable objects, their teeth to be intermeshed successively change. Specifically, the teeth starting to be intermeshed and the teeth ceasing to be intermeshed successively change. This may result in slight changes of the driving force transmitted between these changing teeth and thereby transmitted between the pulleys and the belts whenever the teeth start to be intermeshed and cease to be intermeshed.

Especially, in the motor pulley 74 having a relatively small number of motor-side teeth 76, each one of the motor-side teeth 76 conveys a proportionately larger portion of the driving force to be transmitted by the whole motor pulley 74. This may lead to a relatively larger variation of the driving force transmitted between the motor pulley 74 and the first belt 84. In the motor pulley 74 having a relatively small diameter, a part of the first belt 84 wound around the motor pulley 74 has a smaller curvature radius, meaning that the part has a sharp curve. Whenever the teeth start to be intermeshed or cease to be intermeshed, therefore, the curve of the first belt 84 may undergo relatively large changes. Such largely changing curves may affect the driving force to be greatly variable when transmitted between the motor pulley 74 and the first belt 84.

In case a spur gear pulley is used as the motor pulley 74 having the motor-side teeth 76 formed along the motor shaft 72, a helical gear-less driving force 212 transmitted from the motor pulley 74 to the first belt 84 marks a sudden increase at timings when the unengaged motor-side teeth 76 and belt-side teeth 86 start to be intermeshed. On the other hand, the helical gear-less driving force 212 suddenly diminishes at timings when the intermeshed motor-side teeth 76 and belt-side teeth 86 are mutually disengaged. Hence, the helical gear-less driving force 212 may be greatly variable relative to the rotation of the motor pulley 74, meaning a great deal of variation per unit time.

Figure 14:
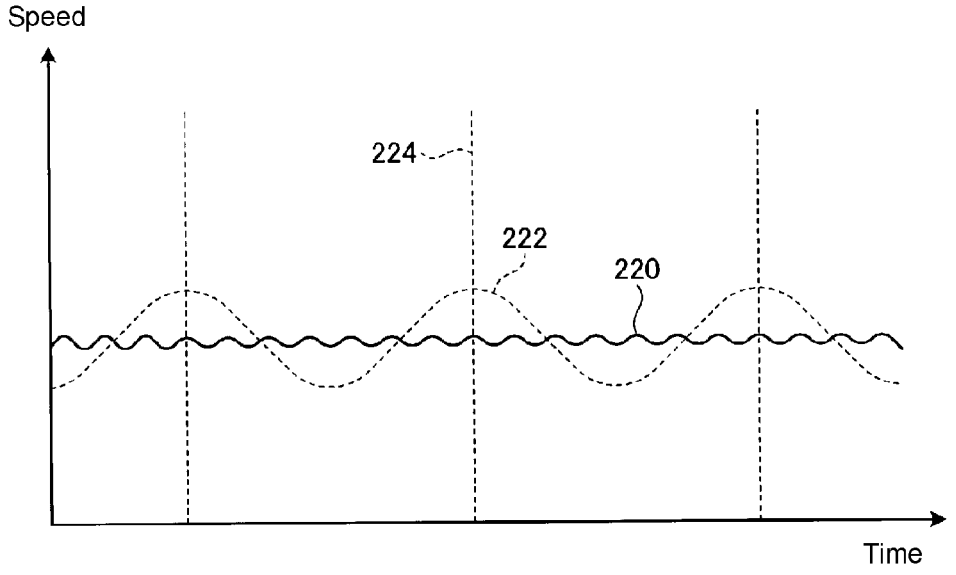
FIG. 14 is a graphical illustration of speed changes of an ink-jet head.

FIG. 14 is a graphical illustration of speed changes of the ink-jet head. In case the driving force is greatly changeable, the ink-jet head 12 moved in the Y direction by the driving force changes its moving speed depending on the changing driving force. The moving speed of the ink-jet head 12 moved by the helical gear-less driving force 212, or a helical gear-less moving speed 222, is greatly variable in response to the greatly changing helical gear-less driving force 212.

The ink-jet head 12 discharges the ink droplets while moving in the Y direction. The ink on the print object 50, therefore, changes in density depending on the speed of the ink-jet head 12. In any part of the print object 50 where the helical gear-less moving speed 222 is greatly variable, variable-density streaks 224 may appear. This is a part where contrasting shades of the ink are more noticeable. The printing operation advances on the print object 50 in the X direction with the ink density randomly changing in the Y direction. The part where the ink density is greatly variable, therefore, may appear in the form of variable-density streaks 224 running in the X direction.

In the ink-jet printer 1 according to this embodiment, however, the motor-side teeth 76 are inclined relative to the direction of axis of the motor pulley 74. A motor-side tooth 76, when starting to mesh with the belt-side tooth 86, first, meshes with one end part of the belt-side tooth 8, further meshing with a larger portion of the belt-side tooth 86 by degrees toward the other end part of the belt-side tooth 86 as the motor pulley 74 further rotates. On the other hand, a motor-side tooth 76, when ceasing to mesh with the belt-side tooth 86, starts to depart from one end part of the belt-side tooth 86, further moving away from a larger portion of the belt-side tooth 86 by degrees toward the other end part of the belt-side tooth 86 as the motor pulley 74 further rotates.

Thus, the motor-side teeth 76 start and cease to be intermeshed with the belt-side teeth 86 by degrees. Hence, the driving force also starts and ceases to be transmitted by degrees from the motor-side teeth 76 to the belt-side teeth 86. In the ink-jet printer 1 according to this embodiment, the driving force transmitted between the motor pulley 74 and the first belt 84 is less variable when the teeth start and cease to be intermeshed.

In the ink-jet printer 1 according to this embodiment wherein the motor pulley 74 is a helical gear pulley, therefore, the driving force transmitted from the motor pulley 74 to the first belt 84, or a helical gear driving force 210, increases by degrees when the unengaged motor-side teeth 76 and belt-side teeth 86 start to be intermeshed. When the intermeshed motor-side teeth 76 and belt-side teeth 86 are mutually disengaged, the helical gear driving force 210 diminishes by degrees. Hence, the helical gear driving force 210 may be less variable relative to the rotation of the motor pulley 74, that is, less variability per unit time.

With the driving force thus reduced in variation, the moving speed of the ink-jet head 12 moved by the helical gear driving force 210, or helical gear moving speed 220, is also reduced in variation. Then, contrasting shades of the ink on the print object 50 may be unlikely, making the variable-density streaks 224 unlikely to appear. The ink-jet printer 1 according to this embodiment may favorably print an image or the like on the print object 50 without undergoing the variable-density streaks 224 running in the sub scanning direction.

The ink-jet printer 1 according to this embodiment described above may be structurally advantageous in that the motor-side teeth 76 of the motor pulley 74 and the belt-side teeth 86 of the first belt 84 to be intermeshed are a combination of intermeshable spur gear teeth and helical gear teeth. This may lessen variability of the driving force when the driving force is transmitted from the motor pulley 74 to the first belt 84. This may reduce speed changes of the ink-jet head 12 during the printing operation, reducing the likelihood of contrasting shades of the ink in the main scanning direction on the print object 50. As a result, streaks appearing on a print result in the sub scanning direction may be reducible, and a high-quality printing may be achieved.

The belt-side teeth 86 of the first belt 84 and the motor-side teeth 76 of the motor pulley 74 smaller in diameter than the decelerating pulley 80 are a combination of intermeshable spur gear teeth and helical gear teeth. This may lessen variability of the driving force in any part of the toothed belts and the pulleys for toothed belt where the driving force to be transmitted may be easily variable. This may more reliably reduce speed changes of the ink-jet head 12 during the printing operation, further reducing the possibility of streaks on a print result in the sub scanning direction.

As for the motor pulley 74 and the decelerating pulley 80 in the ink-jet printer disclosed herein, the motor-side teeth 76 of the motor pulley 74 which is an example of the upstream pulley and the belt-side teeth 86 of the first belt 84 are a combination of intermeshable spur gear teeth and helical gear teeth. Therefore, variability of the driving force may be reduced at positions on the upstream side of the driving force transmitting path. The driving force generated by the motor 70 may be thereby reduced in variation and then transmitted toward the ink-jet head 12. This may more reliably reduce the speed changes of the ink-jet head 12. As a result, streaks on a print result in the sub scanning direction may be more effectively reduced.

In the ink-jet printer disclosed herein, a group of the deceleration-side teeth 82 of the decelerating pulley 80 and the belt-side teeth 86 of the first belt 84 to be intermeshed are a combination of intermeshable spur gear teeth. Then, an accurate rotation angle may be ensured when the driving force is transmitted toward the ink-jet head 12. This may reduce the speed changes of the ink-jet head 12, while maintaining accuracy in the movement of the ink-jet head 12 in the main scanning direction during the printing operation. As a result, streaks on a print result may be reduced in the sub scanning direction with a high printing accuracy being secured, further high-quality printing may be achieved.

By allowing the decelerating pulley 80 to rotate integrally with the driving pulley 90 on which the second belt 94 is wound around, the driving force is transmitted from the first belt 84 toward the ink-jet head 12. Then, the driving force may be reduced in variation and then transmitted toward the ink-jet head 12. This may more reliably reduce speed changes of the ink-jet head 12 during the printing operation, further reducing the possibility of streaks on a print result in the sub scanning direction.

Modified Example

In the ink-jet printer 1 described above, the deceleration-side teeth 82 of the decelerating pulley 80 and the belt-side teeth 86 of the first belt 84 include spur gear teeth, while the motor-side teeth 76 of the motor pulley 74 include helical gear teeth. The spur gear teeth and helical gear teeth may be combined otherwise. For example, the motor-side teeth 76 of the motor pulley 74 and the belt-side teeth 86 of the first belt 84 may include helical gear teeth, while the deceleration-side teeth 82 of the decelerating pulley 80 may include helical gear teeth. Alternatively, the motor-side teeth 76 of the motor pulley 74 and the deceleration-side teeth 82 of the decelerating pulley 80 may include spur gear teeth, while the belt-side teeth 86 of the first belt 84 may include helical gear teeth.

As for the teeth of the motor pulley 74, decelerating pulley 80, and first belt 84, at least one of a group of the motor-side teeth 76 of the motor pulley 74 and the belt-side teeth 86 of the first belt 84 and a group of the deceleration-side teeth 82 of the decelerating pulley 80 and the belt-side teeth 86 of the first belt 84 may preferably be a combination of intermeshable spur gear teeth and helical gear teeth. In so far as at least one of these groups of teeth is a combination of intermeshable spur gear teeth and helical gear teeth, the driving force generated by the motor 70 may be less variable when the driving force is transmitted from the motor pulley 74 toward the decelerating pulley 80. This may reduce speed changes of the ink-jet head 12 moved by the driving force generated by the motor 70, reducing the likelihood of contrasting shades of the ink in the main scanning direction on the print object 50. As a result, streaks may be reduced on a print result in the sub scanning direction.

In addition, the ink-jet printer 1 described above, in order to move the ink-jet head 12, decelerates the driving force generated by the motor 70 using the motor pulley 74 and the decelerating pulley 80 and then transmits the decelerated driving force to the second belt 94 using the driving pulley 90. However, the driving force transmission path may be configured otherwise. For example, the driving pulley 90 may be attached to the motor shaft 72 so that the driving pulley 90 is directly rotated by the driving force generated by the motor 70. In this instance, the driving pulley 90 is an upstream pulley rotated by the driving force generated by the drive source motor 70. The second belt 94 is a toothed belt wound around the driving pulley 90, or upstream pulley, and serving to transmit the driving force from the driving pulley 90 toward the ink-jet head 12. The driven pulley 92 is a downstream pulley on which the second belt 94 is wound around to be rotated by the driving force transmitted on the second belt 94.

As such, at least one of a group of the teeth to be intermeshed of the driving pulley 90 and of the second belt 94 and a group of the teeth to be intermeshed of the driven pulley 92 and of the second belt 94 may preferably be a combination of intermeshable spur gear teeth and helical gear teeth. In so far as at least one of these groups of teeth is a combination of intermeshable spur gear teeth and helical gear teeth, the driving force generated by the motor 70 may be less variable when the driving force is transmitted from the driving pulley 90 toward the second belt 94. This may reduce speed changes of the ink-jet head 12 moved by the driving force generated by the motor 70, reducing the likelihood of contrasting shades of the ink in the main scanning direction on the print object 50. As a result, streaks may be reduced to appear in the sub scanning direction on a print result.

The ink-jet printer 1 may be variously configured by suitably combining the structural and technical features described in the embodiment and the modified example, or the ink-jet printer 1 may be configured otherwise. Aside from the structural and technical features of the ink-jet printer 1, it is essential to include a combination of intermeshable spur gear teeth and helical gear teeth in the teeth involved in transmitting the driving force generated by the drive source toward the ink-jet head by way of the toothed belts and the pulleys for toothed belt. This may adequately lessen variability of the transmitted driving force, consequently reducing streaks appearing in the sub scanning direction on a print result.

The invention claimed is:

1. An ink jet printer, comprising:

an ink-jet head that discharges an ink on a print object while moving in a main scanning direction relative to the print object;

a drive source that generates a driving force by which the ink jet head is moved;

an upstream pulley to be rotated by the driving force generated by the drive source;

a toothed belt wound around the upstream pulley to transmit the driving force from the upstream pulley toward the ink-jet head; and a downstream pulley on which the toothed belt is wound around to be rotated by the driving force transmitted on the toothed belt, wherein the upstream pulley and the downstream pulley have teeth adapted to mesh with teeth of the tooted belt, and at least one of a group of the teeth of the upstream pulley and the teeth of the toothed belt to be intermeshed and a group of the teeth of the downstream pulley and the teeth of the toothed belt to be intermeshed is a combination of intermeshable spur gear teeth and helical gear teeth.

2. The ink-jet printer according to claim 1, wherein the upstream pulley and the downstream pulley have different diameters, and a group of the teeth to be intermeshed of the toothed belt and of one of the upstream pulley and the downstream pulley smaller in diameter than the other is a combination of intermeshable spur gear teeth and helical gear teeth.

3. The ink jet printer according to claim 2, wherein the upstream pulley is smaller in diameter than that of the downstream pulley.

4. The ink-jet printer according to claim 3, wherein at least one of a group of the teeth of the toothed belt and the teeth of the upstream pulley to be intermeshed and a group of the teeth of the toothed belt and the teeth of the downstream pulley to be intermeshed is a combination of intermeshable spur gear teeth and helical gear teeth, and the other group is a combination of intermeshable spur gear teeth.

5. The ink-jet printer according to claim 3, wherein the downstream pulley transmits the driving force transmitted on the toothed belt toward the ink-jet head.

6. The ink-jet printer according to claim 2, wherein at least one of a group of the teeth of the toothed belt and the teeth of the upstream pulley to be intermeshed and a group of the teeth of the toothed belt and the teeth of the downstream pulley to be intermeshed is a combination of intermeshable spur gear teeth and helical gear teeth, and the other group is a combination of intermeshable spur gear teeth.

7. The ink-jet printer according to claim 2, wherein the downstream pulley transmits the driving force transmitted on the toothed belt toward the ink-jet head.

8. The ink jet printer according to claim 1, wherein at least one of a group of the teeth of the toothed belt and the teeth of the upstream pulley to be intermeshed and a group of the teeth of the toothed belt and the teeth of the downstream pulley to be intermeshed is a combination of intermeshable spur gear teeth and helical gear teeth, and the other group is a combination of intermeshable spur gear teeth.

9. The ink-jet printer according to claim 8, wherein the downstream pulley transmits the driving force transmitted on the toothed belt toward the ink-jet head.

10. The ink jetprinter according to claim 1, wherein the downstream pulley transmits the driving force transmitted on the toothed belt toward the ink-jet head.

* * * * *